US009862070B2

(12) United States Patent
Chang et al.

(10) Patent No.: US 9,862,070 B2
(45) Date of Patent: *Jan. 9, 2018

(54) SYSTEMS AND METHODS FOR SUBSTRATE POLISHING END POINT DETECTION USING IMPROVED FRICTION MEASUREMENT

(75) Inventors: Shou-Sung Chang, Redwood City, CA (US); Hung Chen, Sunnyvale, CA (US); Lakshmanan Karuppiah, San Jose, CA (US); Paul D. Butterfield, San Jose, CA (US); Erik S. Rondum, San Ramon, CA (US)

(73) Assignee: Applied Materials, Inc., Santa Clara, CA (US)

( * ) Notice: Subject to any disclaimer, the term of this patent is extended or adjusted under 35 U.S.C. 154(b) by 1090 days.

This patent is subject to a terminal disclaimer.

(21) Appl. No.: 13/459,071

(22) Filed: Apr. 27, 2012

(65) Prior Publication Data

US 2013/0122782 A1 May 16, 2013

Related U.S. Application Data

(60) Provisional application No. 61/560,793, filed on Nov. 16, 2011.

(51) Int. Cl.

| | |
|---|---|
| ***B24B 49/00*** | (2012.01) |
| ***B24B 37/013*** | (2012.01) |
| ***B24B 49/16*** | (2006.01) |

(52) U.S. Cl.

CPC ..... *B24B 37/013* (2013.01); *B24B 49/16* (2013.01)

(58) Field of Classification Search

USPC ..... 451/8, 36, 59, 178, 285, 286

See application file for complete search history.

(56) References Cited

U.S. PATENT DOCUMENTS

| | | | |
|---|---|---|---|
| 5,597,341 | A | 1/1997 | Kodera et al. |
| 5,643,061 | A | 7/1997 | Jackson et al. |

(Continued)

FOREIGN PATENT DOCUMENTS

| | | | |
|---|---|---|---|
| CN | 1859998 | A | 11/2006 |
| CN | 1871504 | A | 11/2006 |

(Continued)

OTHER PUBLICATIONS

International Search Report & Written Opinion of International Application No. PCT/US2012/065128 dated Mar. 8, 2013.

(Continued)

*Primary Examiner* — Joseph J Hail
*Assistant Examiner* — Shantese McDonald
(74) *Attorney, Agent, or Firm* — Dugan & Dugan, PC

(57) ABSTRACT

Methods, apparatus, and systems for polishing a substrate are provided. The invention includes an upper platen; a torque/strain measurement instrument coupled to the upper platen; and a lower platen coupled to the torque/strain measurement instrument and adapted to drive the upper platen to rotate through the torque/strain measurement instrument. In other embodiments, the invention includes an upper carriage; a side force measurement instrument coupled to the upper carriage; and a lower carriage coupled to the side force measurement instrument and adapted to support a polishing head. Numerous additional aspects are disclosed.

14 Claims, 18 Drawing Sheets

(56) References Cited

U.S. PATENT DOCUMENTS

| | | | | |
|---|---|---|---|---|
| 5,899,800 | A | 5/1999 | Shendon | |
| 5,904,609 | A | 5/1999 | Fukuroda et al. | |
| 6,068,549 | A | 5/2000 | Jackson | |
| 6,149,506 | A * | 11/2000 | Duescher | 451/59 |
| 6,206,754 | B1 * | 3/2001 | Moore | B24B 21/004 451/296 |
| 6,998,013 | B2 | 2/2006 | Jan et al. | |
| 7,166,019 | B2 | 1/2007 | Park et al. | |
| 7,335,088 | B1 | 2/2008 | Hwang et al. | |
| 7,625,495 | B2 | 12/2009 | Hofmann et al. | |
| 2001/0012750 | A1 | 8/2001 | Moore | |
| 2001/0024880 | A1 | 9/2001 | Hofmann et al. | |
| 2002/0037681 | A1 * | 3/2002 | Gitis | 451/5 |
| 2002/0090889 | A1 * | 7/2002 | Crevasse et al. | 451/8 |
| 2004/0005845 | A1 | 1/2004 | Kitajima et al. | |
| 2004/0134287 | A1 | 7/2004 | Lin et al. | |
| 2005/0070209 | A1 | 3/2005 | Marxsen et al. | |
| 2006/0172662 | A1 | 8/2006 | Lim et al. | |
| 2007/0032171 | A1 | 2/2007 | Chandrasekaran | |
| 2014/0260624 | A1 | 9/2014 | Subrahmanyam et al. | |

FOREIGN PATENT DOCUMENTS

| | | | |
|---|---|---|---|
| CN | 101515537 | A | 8/2009 |
| JP | H10-256209 | | 9/1998 |
| JP | 2001-358104 | | 12/2001 |
| JP | 2004-209564 | | 7/2004 |
| JP | 2007-510164 | | 4/2007 |
| JP | 2008-036802 | | 2/2008 |
| TW | 200410792 | A | 7/2004 |

OTHER PUBLICATIONS

International Search Report & Written Opinion of International Application No. PCT/US2012/065127 dated Mar. 8, 2013.

Chang et al., U.S. Appl. No. 13/459,079, filed Apr. 28, 2012.

Office Action of U.S. Appl. No. 13/459,079 dated Mar. 27, 2014.

International Preliminary Report on Patentability of International Application No. PCT/US2012/065128 dated May 30, 2014.

International Preliminary Report on Patentability of International Application No. PCT/US2012/065127 dated May 30, 2014.

Jun. 27, 2014 Reply to Mar. 27, 2014 Office Action of U.S. Appl. No. 13/459,079.

Dec. 18, 2014 Reply to Sep. 18, 2014 Office Action of U.S. Appl. No. 13/459,079.

Office Action of U.S. Appl. No. 13/459,079 dated Sep. 18, 32014.

Chew et al., U.S. Appl. No. 13/874,495, titled "Apparatus and Methods for Acoustical Monitoring and Control of Through-Silicon-Via Reveal Processing," filed May 1, 2013.

Notice of Allowance of U.S. Appl. No. 13/459,079 dated Feb. 2, 2015.

Chinese Search Report of Chinese Application No. 201280059506.9 dated Jan. 19, 2016.

Chinese Search Report of Chinese Application No. 201280059528.5 dated Dec. 21, 2015.

Taiwan Search Report of Taiwan Application No. 101142646 dated Aug. 27, 2016.

Taiwan Search Report of Taiwan Application No. 101142647 dated Oct. 7, 2016.

* cited by examiner

SYSTEMS AND METHODS FOR SUBSTRATE POLISHING END POINT DETECTION USING IMPROVED FRICTION MEASUREMENT

RELATED APPLICATIONS

The present invention is related to and claims priority to U.S. Provisional Patent Application No. 61/560,793, filed on Nov. 16, 2011, entitled "SYSTEMS AND METHODS FOR SUBSTRATE POLISHING END POINT DETECTION USING IMPROVED FRICTION MEASUREMENT," the entirety of which is incorporated herein by reference.

FIELD OF THE INVENTION

The present invention generally relates to electronic device manufacturing, and more particularly is directed to semiconductor substrate polishing systems and methods.

BACKGROUND OF THE INVENTION

Substrate polishing end point detection methods may use an estimate of the torque required to rotate a polishing pad against a substrate held within a polishing head to determine when sufficient substrate material has been removed. Existing substrate polishing systems typically use electrical signals from the actuator (e.g., motor current) to estimate the amount of torque required to rotate the pad against the substrate. The inventors of the present invention have determined that in some circumstances such methods may not be accurate enough to determine consistently when an end point has been reached. Accordingly, improvements are needed in the field of substrate polishing end point detection.

SUMMARY OF THE INVENTION

Inventive methods and apparatus provide for polishing a substrate. In some embodiments, the apparatus includes an upper platen; a torque/strain measurement instrument flexibly coupled to the upper platen; and a lower platen coupled to the torque/strain measurement instrument. The upper platen is driven through the torque/strain measurement instrument by the lower platen which is driven by an actuator.

In some other embodiments, a system for chemical-mechanical planarization processing of substrates is provided. The system includes a polishing pad attached to upper platen; and a substrate carrier adapted to hold and rotate a substrate against the polishing pad. The polishing platen assembly includes an upper platen; a torque/strain measurement instrument flexibly coupled to the upper platen; and a lower platen coupled to the torque/strain measurement instrument and adapted to drive the upper platen to rotate through the torque/strain measurement instrument.

In yet other embodiments, a method of polishing a substrate is provided. The method includes coupling a lower platen to an upper platen via a torque/strain measurement instrument, the upper platen adapted to hold a polishing pad; rotating the lower platen to drive the upper platen; applying a polishing head holding a substrate to the polishing pad on the upper platen; and measuring an amount of torque needed to rotate the upper platen as the substrate is polished.

In still yet other embodiments, an apparatus is provided for polishing a substrate. The apparatus includes an upper carriage; a side force measurement instrument coupled to the upper carriage; and a lower carriage coupled to the side force measurement instrument and adapted to support a polishing head.

In some other embodiments, a system for chemical-mechanical planarization processing of substrates is provided. The system includes a polishing head assembly adapted to hold a substrate; and a polishing pad support adapted to hold and rotate a polishing pad against the substrate held in the polishing head, the polishing head assembly including: an upper carriage; a side force measurement instrument coupled to the upper carriage; a lower carriage coupled to the side force measurement instrument; and polishing head coupled to the lower carriage and adapted to hold the substrate.

In yet other embodiments, a method of polishing a substrate is provided. The method includes rotating a platen supporting a polishing pad; coupling an upper carriage to a lower carriage via a side force measurement instrument, the lower carriage adapted to support a polishing head adapted to hold a substrate; applying the polishing head holding a substrate to the polishing pad on the platen; and measuring an amount of side force on the substrate as the substrate is polished.

In other embodiments, an apparatus is provided for polishing a substrate. The apparatus includes an upper carriage; a displacement measurement instrument coupled to the upper carriage; and a lower carriage coupled to the displacement measurement instrument and adapted to support a polishing head.

Numerous other aspects are provided. Other features and aspects of the present invention will become more fully apparent from the following detailed description, the appended claims, and the accompanying drawings.

DETAILED DESCRIPTION

Figure 1:
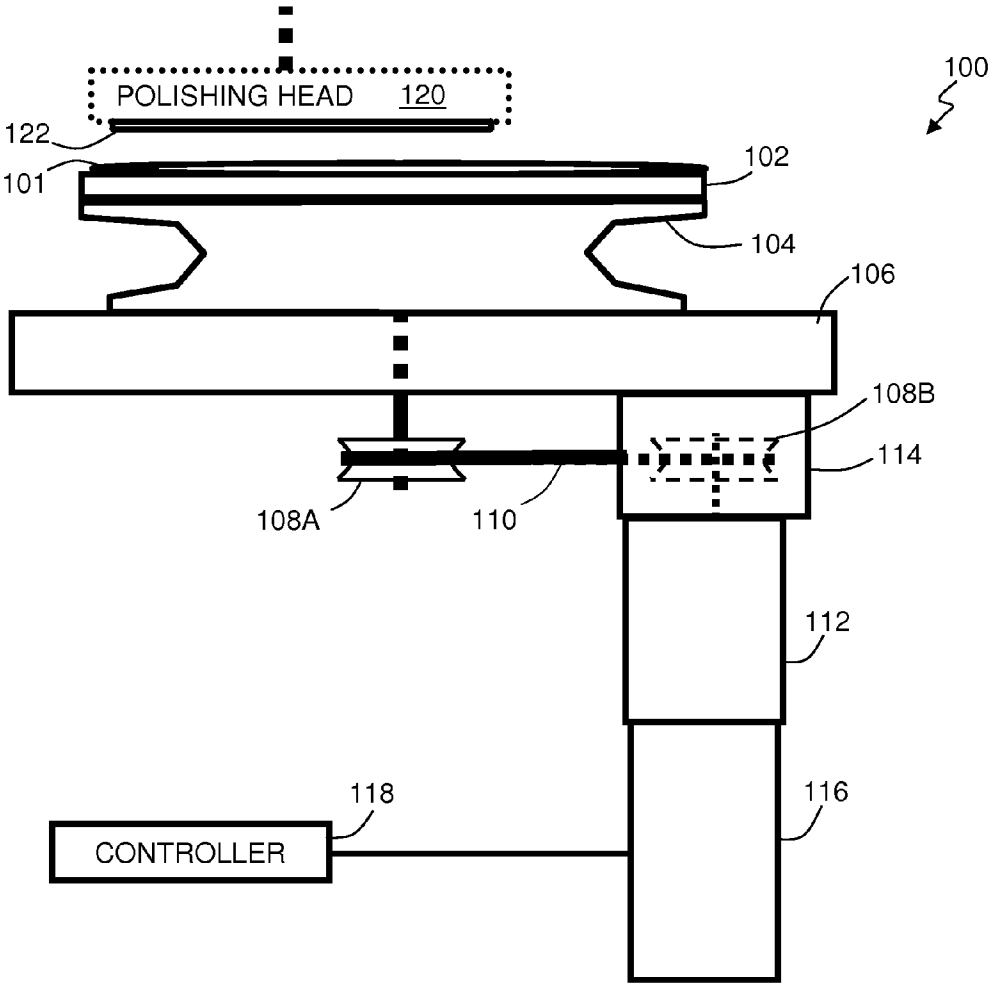
FIG. 1 is a side elevation view of a platen rotation portion of a substrate polishing system in accordance with an embodiment of the present invention.

Existing substrate polishing systems (e.g., chemical mechanical planarization (CMP) systems) that use electrical signals (e.g., current, voltage, power, etc.), taken from the motor used to drive the polishing pad support platen, to estimate the amount of torque required to rotate the polishing pad against a substrate held in a polishing head may be inaccurate in some circumstances due to a number of error sources. Some of these error sources include actuator intrinsic characteristics variation (e.g. variations in windings and magnets), transmission component tolerances (e.g., gearbox, belts, pulleys, etc.), bearing friction, and temperature variation.

The present invention provides improved methods and apparatus for accurately determining the friction encountered while rotating a polishing pad against a substrate held in a polishing head in a polishing system. The invention provides methods of minimizing or avoiding the above-mentioned error sources by adding direct torque and/or strain measuring instruments, in line with and/or adjacent to the platen supporting the polishing pad. The in-line torque/strain measurement instruments directly measure the physical quantities (e.g., the amount of rotational force) required to rotate the polishing pad against the substrate held in the polishing head. Moving the measurement point directly in line with and/or adjacent to the polishing pad support platen minimizes error from components in the drive train.

In some embodiments, one or more supports are added coupling a lower platen (e.g., the driving component rigidly coupled to the actuator) and an upper platen (e.g., the driven component which holds the polishing pad). These supports are adapted to bear the thrust, radial, and moment loads created by rotating the lower platen to drive the upper platen, yet allow only one degree of freedom (e.g., rotational) for the upper platen to move relative to the lower platen. The driving torque of the actuator is passed through the torque/strain measurement instrument (from driving the lower platen) to the upper platen. As the load of the polishing head is applied to the polishing pad held on the upper platen, the torque/strain measurement instrument can be used to measure the additional torque required to overcome the polishing head load and to maintain the rotation of the upper platen.

The support also acts as a protection to the strain measurement device by limiting the differential amount of torque that can be applied to the upper platen and the lower platen. In some embodiments, the support may be, for example, any combination of the following types of bearings: an air bearing, a fluid bearing, a magnetic bearing, a deep groove bearing, an angular contact bearing, a roller bearing, and/or a tapered cross-roller bearing. In some embodiments, the support may alternatively be a pivot made, for example, of a flexure. In some embodiments, the strain measurement device may be, for example, a torque sensor, an in-line rod end load cell, or strain gauges on the pivots/flexures. In general, any suitable and practicable support and/or strain measurement device may be used.

In some embodiments, instead of measuring the torque and/or strain in line with and/or adjacent to the platen supporting the polishing pad, the present invention provides methods and apparatus to measure the side force applied to the substrate in the polishing head. Side force measurement instruments may be disposed between an upper and lower carriage that supports the polishing head. When the polishing pad pushes on the substrate in the polishing head, the side force measurement instruments can directly measure the force that is proportionate to the friction between the substrate and the polishing pad. As with prior embodiments, supports that only allow limited motion in one direction may be used to bear the thrust, radial, and moment loads created by pressing the substrate into the rotating polishing pad. The supports may also protect the side force measurement instruments by limiting the amount of side movement.

As with the prior embodiments, the supports for the side force measurement embodiments may be, for example, any combination of the following types of bearings: an air bearing, a fluid bearing, a magnetic bearing, a deep groove bearing, an angular contact bearing, a roller bearing, and/or a tapered cross-roller bearing. In some embodiments, the support may alternatively be a pivot made, for example, of a flexure. In some embodiments, the strain measurement device may be, for example, a torque sensor, an in-line rod end load cell, or strain gauges on the pivots/flexures. In general, any suitable and practicable support and/or strain measurement device may be used.

Measuring and monitoring the side force on the substrate in the polishing head to determine the polishing end point based on changes in the relative amount of friction may be advantageous over monitoring the torque in the platens supporting the polishing pad. For example, in a CMP system that concurrently polishes two or more substrates in different polishing heads using one polishing pad, monitoring the side force on each substrate allows independent determination of when the polishing end points have been reached.

Turning to FIG. 1, a platen rotation portion of a substrate polishing system 100 is shown. An upper platen 102 is adapted to support a polishing pad 101 while being rotated during CMP processing. The upper platen 102 may include a chuck, adhesive, or other mechanism to hold the polishing pad 101 securely during processing. The upper platen 102 is flexibly coupled to and driven by a lower platen 104 which is supported by base plate 106. Base plate 106 also supports other portions of the system 100 discussed below. Pulley 108A is coupled to lower platen 104 and to pulley 108B via belt 110. Pulley 108B is coupled to gear box 112 which is supported by bracket 114, which is coupled to and supported by base plate 106. Actuator 116 (e.g., a motor) is also coupled to gear box 112. Actuator 116 is electrically coupled to controller 118. Thus, the lower platen 104 is coupled to actuator 116 via gear box 112, pulleys 108A, 108B, and belt 110, such that actuator 116 can drive the system 100 under the control of controller 118. In some embodiments, the actuator 116 and a polishing head 120 (shown in phantom) which holds the substrate 122 may both operate and function under the control of controller 118 which may be a programmed general-purpose computer processor and/or a dedicated embedded controller.

One of ordinary skill will note that the linkage shown between the actuator 116 and the lower platen 104 is merely exemplary. Many different arrangements could be substituted for the components shown. For example, the actuator 116 could be a direct drive motor coupled directly to the lower platen 104. The gear box 112 is useful to adjust the speed (e.g., revolutions per minute (RPM)) at which pulley 108B is rotated by the actuator 116 to a suitable speed for CMP processes but in some embodiments, an actuator may be selected that is already adapted to operate at a suitable speed. Thus, any practicable means of driving the lower platen 104 may be employed.

In operation, the actuator 116, under control of a system manager (e.g., a controller 118, computer processor, etc. executing software instructions), drives the lower platen 104 to rotate at a desired speed suitable for CMP processes. As will be describe below in more detail, the rotation of the lower platen 104 induces rotation of the upper platen 102 due to the flexible coupling between the two. A polishing pad 101 on the upper platen 102 is rotated against a substrate 122 held in a polishing head 120 (shown in phantom) that applies downward force on the polishing pad 101. The downward force of the polishing head 120 creates resistance to the rotation of the upper platen 102. The resistance is overcome by the actuator 116 rotating the lower platen 104. The amount of torque required to overcome the resistance induced by the polishing head 120 is measured using a torque/strain measurement instrument (not visible in FIG. 1, but see FIG. 2). As the substrate 122 is polished and material is removed, the amount of resistance to rotation changes. Different materials may have different coefficients of friction and depending on the material layer being polished, the amount of torque required to rotate the platens 102, 104 may vary. The end point at which polishing is stopped may correspond to a predefined amount of torque, or change in torque, being measured on the torque/strain measurement instrument. In some embodiments, a threshold amount of change in the amount of torque required to rotate the platens 102, 104 may represent the end point of a polishing process. Note that depending on the materials, the end point threshold change amount may be either an increase in the amount of torque or a decrease in the amount of torque required. An example of torque changes as a function of time is described below with respect to FIG. 8.

Figure 2A:
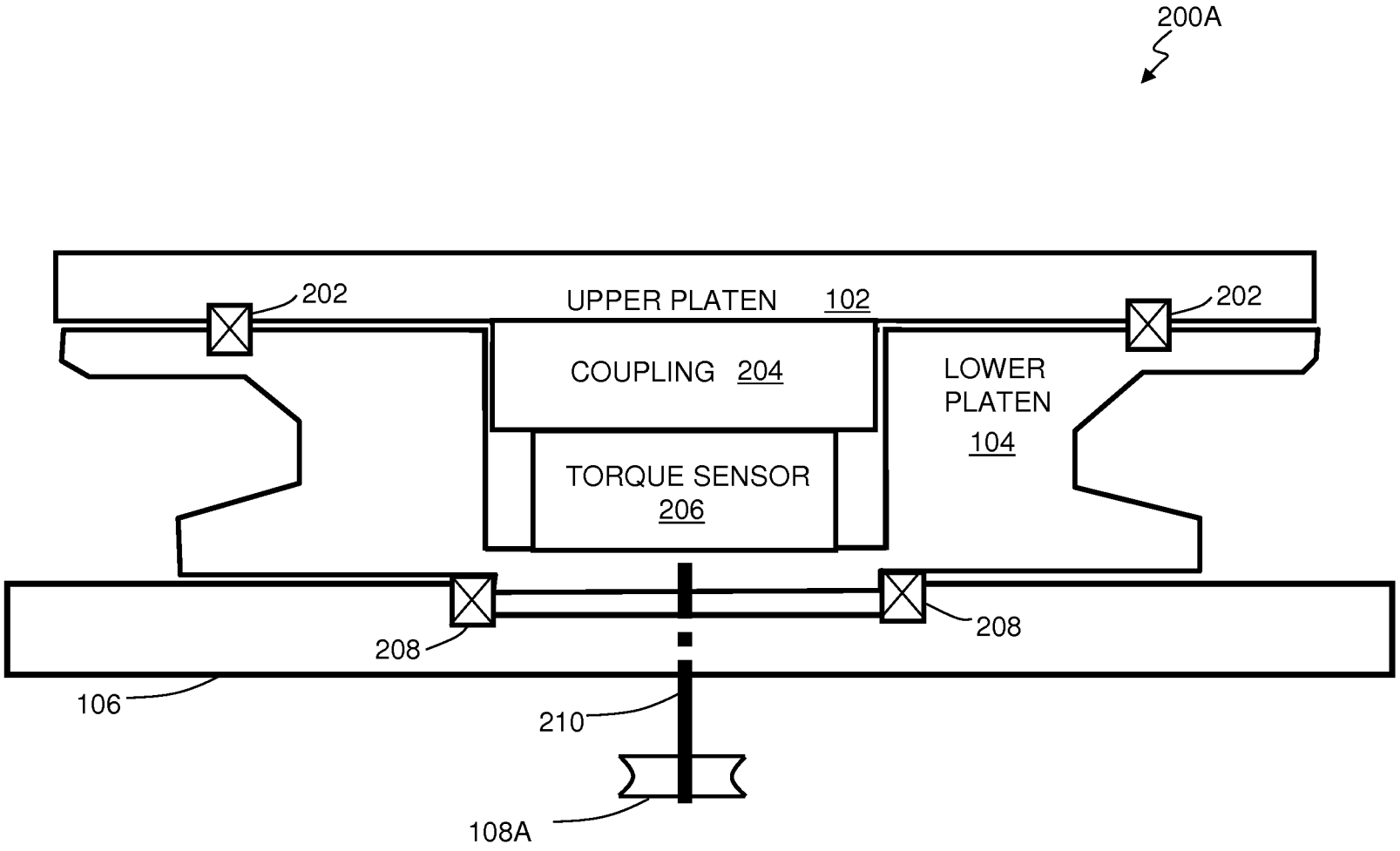
FIG. 2A is a cross-sectional view of part of a platen rotation portion of a substrate polishing system in accordance with a first embodiment of the present invention.

Turning to FIG. 2A, a cross-sectional view of part of an embodiment of a substrate polishing system 200A is shown. Upper platen 102 is supported above lower platen 104 by supports 202. The upper platen 102 is also coupled, via coupling 204, to a torque sensor 206 which serves as the torque/strain measurement instrument in the embodiment of FIG. 2A. The lower platen 104 is supported by and adapted to rotate on bearings 208 on base plate 106. Pulley 108A is coupled to the lower platen 104 via shaft 210 which extends through base plate 106. In some embodiments, the supports 202 and bearings 208 may be implemented as any practicable combination of air bearings, fluid bearings, magnetic bearings, deep groove bearings, angular contact bearings, roller bearings, and/or a cross-roller bearings. For example, RB series cross-roller type bearings manufactured by THK Co., LTD. of Tokyo, Japan may be used. NSK Corporation of Ann Arbor, Mich. manufactures double tapered roller bearings that may be used. XSU Series cross roller-type bearings manufactured by Schaeffler Technologies GmbH & Co. KG, of Herzogenaurach, Germany under the brand name INA may be used. Any suitable and practicable bearing may be employed.

In operation, the supports 202 are adapted to bear the thrust, radial, and over-hanging moment loads created by dynamic interaction between the substrate/carrier and the pad/upper platen, yet allow only one degree of freedom (e.g., rotational) for the upper platen 102 to move relative to the lower platen 104. The driving torque of the actuator 116 (FIG. 1) is passed through the torque/strain measurement instrument (in this case the torque sensor 206) to the upper platen 102. As the load of the polishing head is applied to the polishing pad on the upper platen 102, the torque sensor 206 is adapted to measure the additional torque required to overcome the polishing head load and to drive the upper platen 102.

Figure 2B:
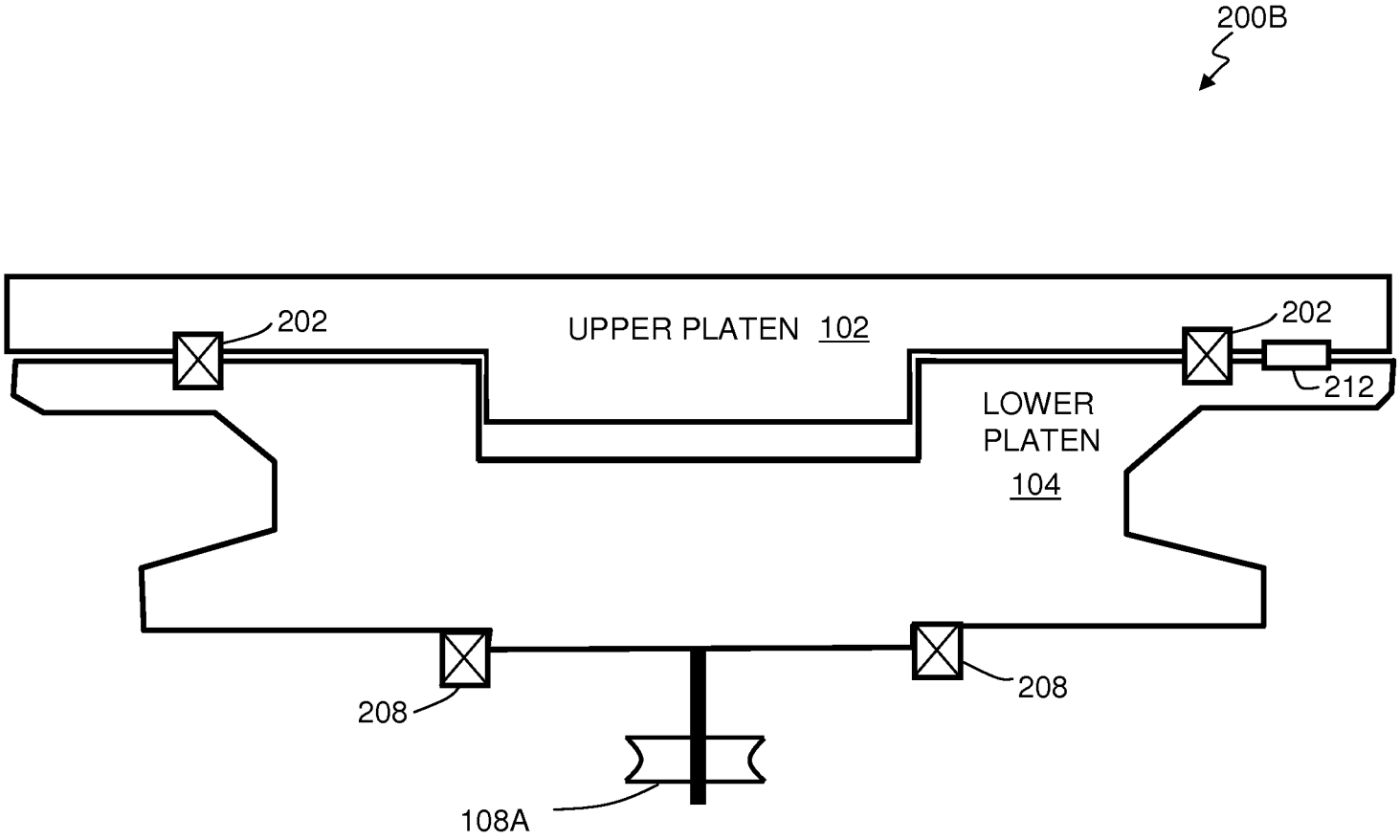
FIG. 2B is a cross-sectional view of part of a platen rotation portion of a substrate polishing system in accordance with a second embodiment of the present invention.

Turning to FIG. 2B, a cross-sectional view of part of a second embodiment of a substrate polishing system 200B is shown. This embodiment is similar to the system 200A of FIG. 2A, except in place of the coupling 204 and torque sensor 206, load cell 212 is used to both link the upper platen 102 and lower platen 104 and to serve as the torque/strain measurement instrument. Examples of a load cell 212 that are commercially available and may be used in some embodiments are the In-Line Load Cell models manufactured by Honeywell Inc. of Columbus, Ohio. Other practicable load cells may be used. For example, a load cell array may be used in some embodiments. In some embodiments, multiple load cells 212 disposed between the platens 102, 104 may be used.

Figure 3A:
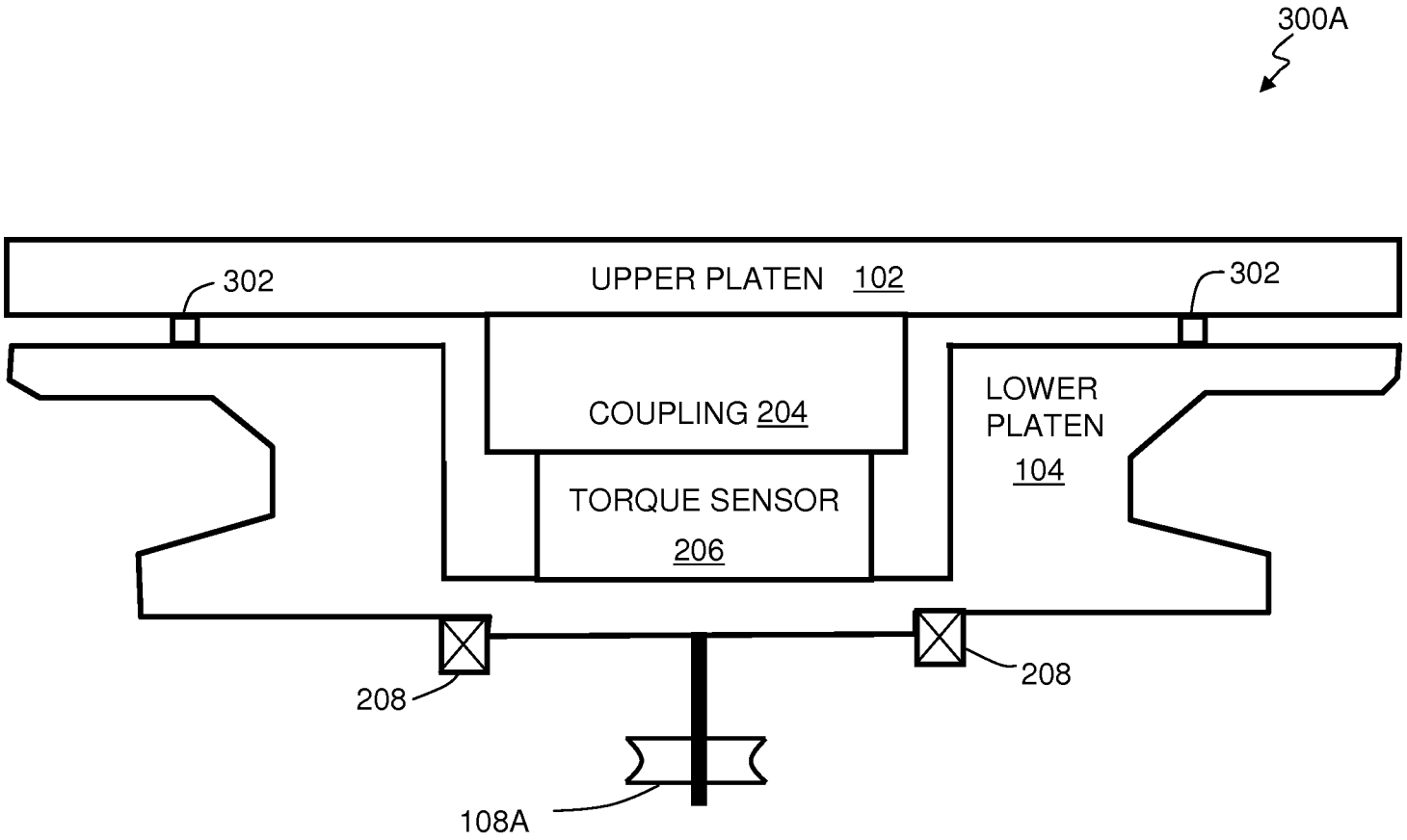
FIG. 3A is a cross-sectional view of part of a platen rotation portion of a substrate polishing system in accordance with a third embodiment of the present invention.

Turning to FIG. 3A, a cross-sectional view of a platen rotation portion of a third alternative embodiment of a substrate polishing system 300A is depicted. Upper platen 102 is supported above lower platen 104 by supports 302. The upper platen 102 is also coupled, via coupling 204, to the torque sensor 206 which is coupled to the lower platen 104 and serves as the torque/strain measurement instrument in the embodiment of FIG. 3A. In some embodiments, the supports 302 may be implemented as a pivot made, for example, of a flexure. Flexures according to embodiments of the present invention are described in detail below with respect to FIGS. 4 and 5.

Figure 3B:
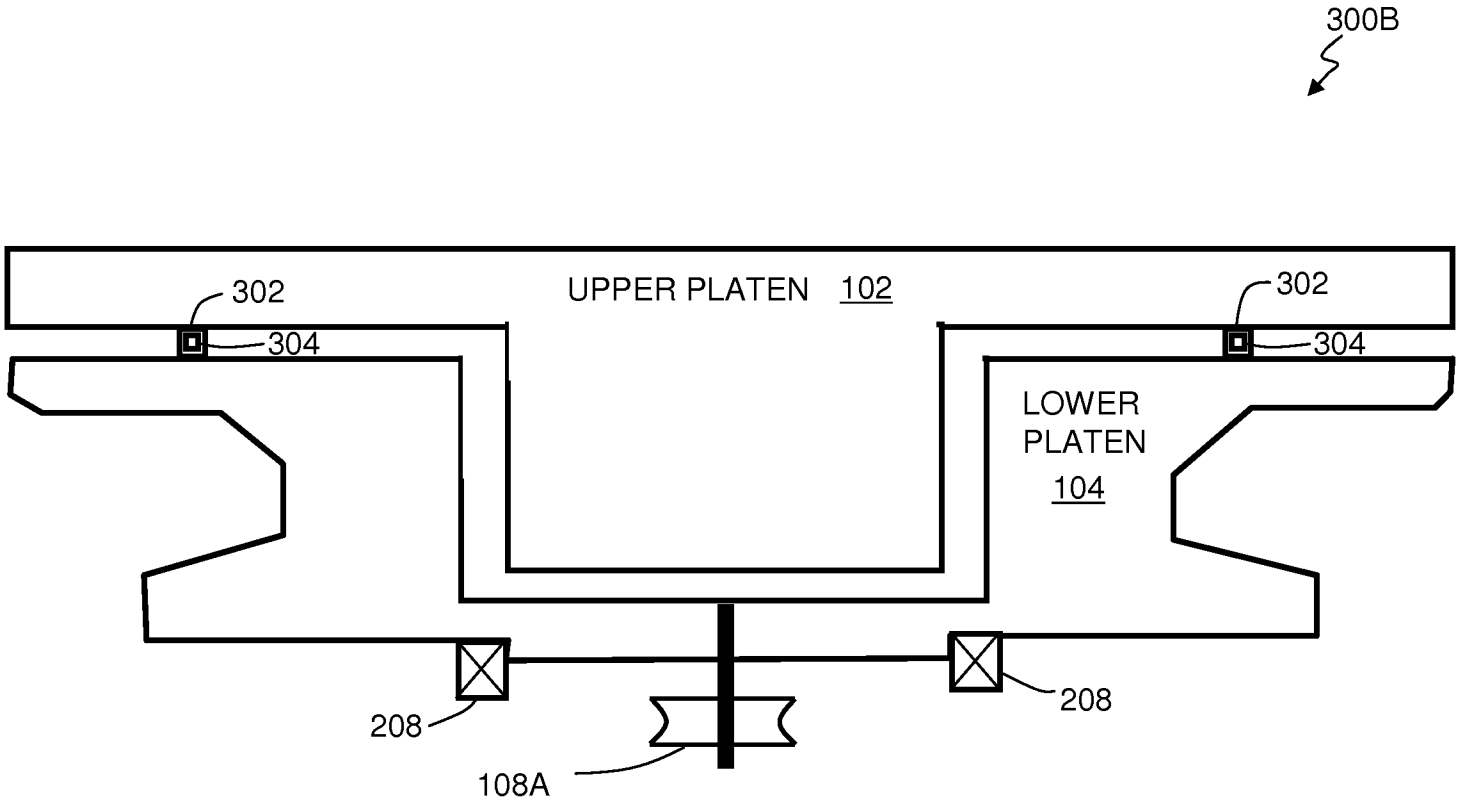
FIG. 3B is a cross-sectional view of part of a platen rotation portion of a substrate polishing system in accordance with a fourth embodiment of the present invention.

Turning to FIG. 3B, a cross-sectional view of a platen rotation portion of a fourth alternative embodiment of a substrate polishing system 300B is depicted. Upper platen 102 is supported above and coupled to lower platen 104 by supports 302. However, in place of torque sensor 206, strain gauges 304 coupled to supports 302 serve as the torque/strain measurement instruments in the embodiment of FIG. 3B. An example of a commercially available strain gauge 304 that may be used in some embodiments is the KFG series strain gauge manufactured by Omega of Stamford, Conn. Other practicable strain gauges may be used. As in the embodiment of FIG. 3A, in some embodiments, the supports 302 may be implemented as a pivot made, for example, of a flexure. Flexures according to embodiments of the present invention are described in detail below with respect to FIGS. 4 and 5.

Figure 3C:
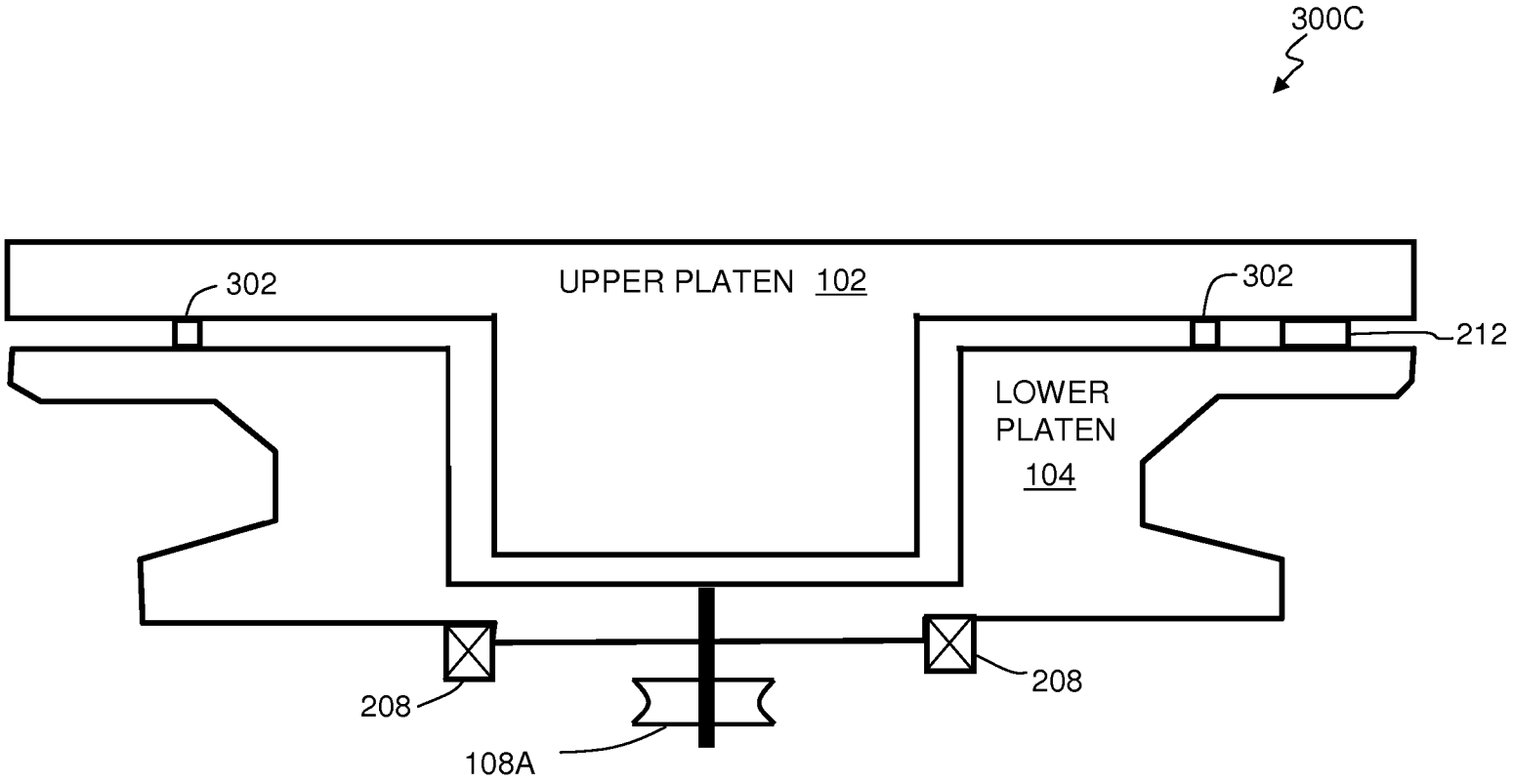
FIG. 3C is a cross-sectional view of part of a platen rotation portion of a substrate polishing system in accordance with a fifth embodiment of the present invention.

Turning to FIG. 3C, a cross-sectional view of a platen rotation portion of a fifth alternative embodiment of a substrate polishing system 300C is depicted. Upper platen 102 is supported above and coupled to lower platen 104 by supports 302. However, in place of strain gauges 304, load cell 212 coupled to the platens 102, 104 serves as the torque/strain measurement instrument in the embodiment of FIG. 3C. As above, examples of a commercially available load cell 212 that may be used in some embodiments are the In-Line Load Cells manufactured by Honeywell Inc. of Columbus, Ohio. In some embodiments, load cell arrays may be used. Other practicable load cells may be used. As in the embodiment of FIG. 3A, in some embodiments, the supports 302 may be implemented as a pivot made, for example, of a flexure. Flexures according to embodiments of the present invention are described in detail below with respect to FIGS. 4 and 5.

Figure 4:
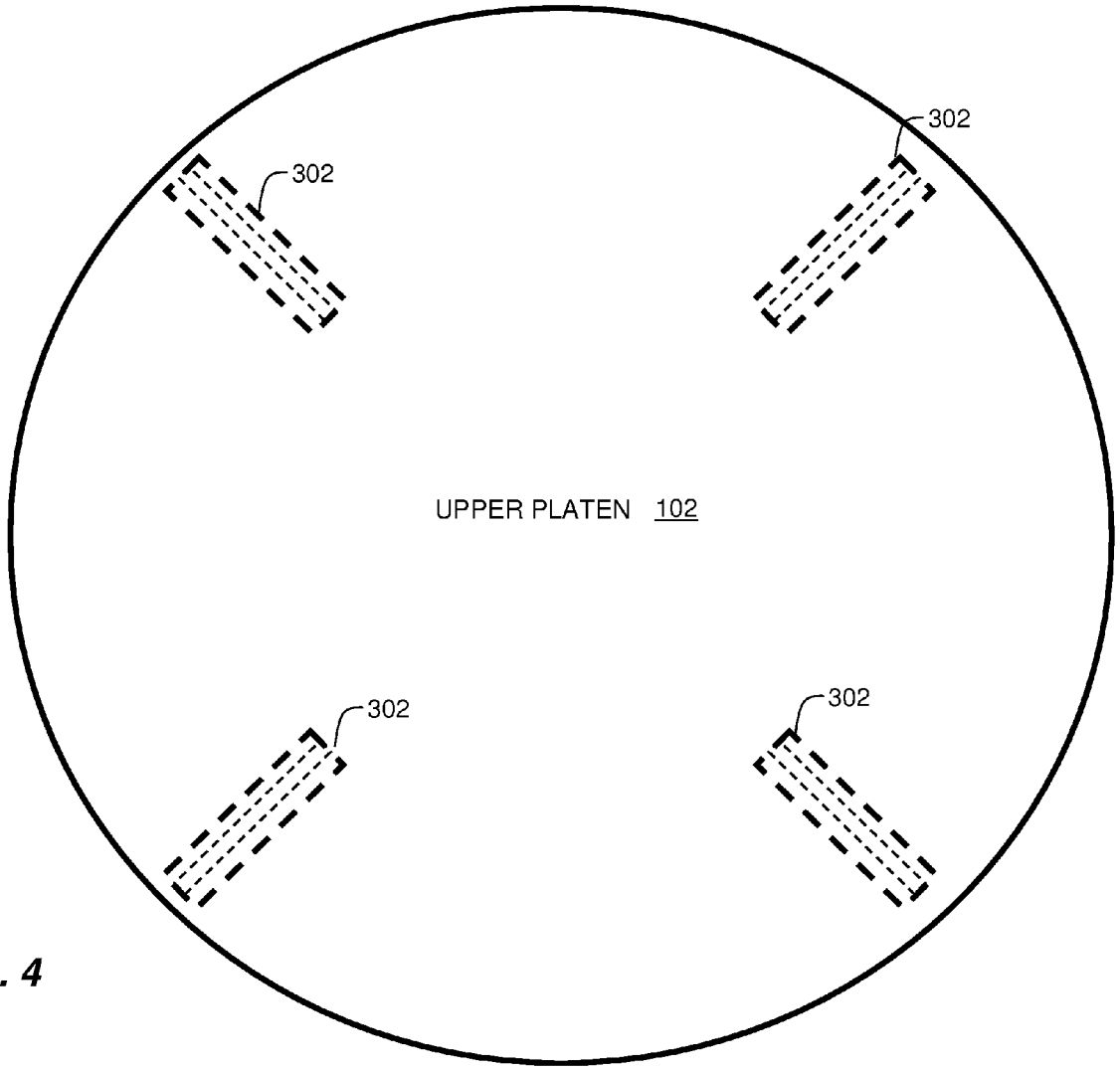
FIG. 4 is a top view of an upper platen supported by flexures in accordance with the third, fourth and fifth embodiments of the present invention.

Turning to FIG. 4, a top view of the upper platen 102 is shown and supporting the upper platen 102 from below is an example arrangement of four flexures 302 shown in phantom. Note that the flexures are disposed each with its longitudinal axis aligned to intersect at the center of rotation of the upper platen 102. Note further that although four flexures 302 are depicted, fewer (e.g., 3) or more (e.g., 5, 6, 7, etc) may be used.

Figure 5:
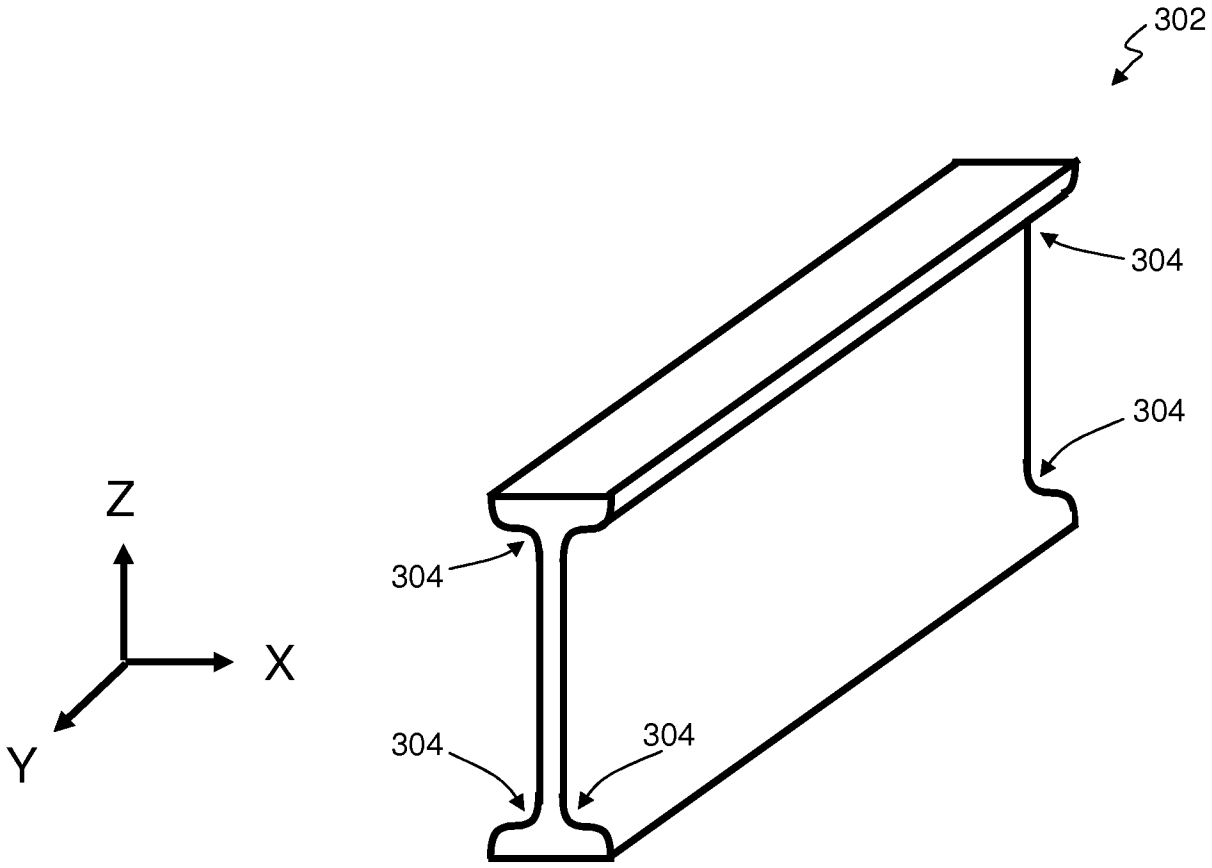
FIG. 5 is a perspective view of an example embodiment of a flexure in accordance with the third, fourth and fifth embodiments of the present invention.

Turning to FIG. 5, an example embodiment of a flexure 302 is shown in perspective view. The cross-section of the example flexure 502 has an I-beam shape. The relatively wide (X dimension) top and bottom of the flexure 302 may include clamping or fastening mechanisms for attachment to the upper platen 102 and lower platen 104, respectively. More generally, a flexure suitable for use with the present invention may include a length of material that is flexible in one direction or dimension but rigid in all others. For example, the depicted I-beam shaped flexure 302 in FIG. 5 may be bendable along the height dimension (Z dimension) that thins between the wider top and bottom regions but inflexible in all other dimensions. In other words, the flexure may be bendable in the X and −X directions (as indicated by the Cartesian reference frame) but not bendable in the Y, −Y, Z, or −Z directions.

Each flexure 302 may be disposed such that the flexible dimension is aligned tangentially (i.e., perpendicularly with a radius) with the rotational direction of the platens 102, 104. In other words, the longitudinal dimension (e.g., along the Y axis) of the flexure 302 is aligned to intersect at the axis of rotation of the platens 102, 104 as shown in FIG. 5. Thus, the flexures 302, coupling the platens 102, 104 together, allow the platens 102, 104 to move slightly relative to each other to the extent that the flexures 302 bend.

In some embodiments, the flexures 302 may be made from stainless steel or any practicable material that can flex without deforming. Example dimensions for a suitable flexure 302 may be from approximately 0.2 cm to approximately 10 cm in height (Z dimension), approximately 1 cm to approximately 30 cm in length (Y dimension), and approximately 0.1 cm to approximately 2 cm in width (X dimension) at the central thin region and approximately 0.1 cm to approximately 5 cm in width (X dimension) at the top and bottom thick regions. In some embodiments, the flexures 302 may include radiused or rounded joints/edges 304 between the wide and narrow dimensions of the flexures as shown in FIG. 5. These radiused joints 304 may allow the flexures 302 to avoid failure from fatigue at the joints 304. In some embodiments, the radius of the joints 304 may be from approximately 0.1 cm to approximately 2 cm. Other flexure materials and/or dimensions may be used.

As indicated above, in some embodiments, a strain gage 304 may be placed upon one or more of the flexures 302 and the torque load between the platens 102, 104 may be measured using the flexures 302 in addition to, or instead of, via a torque sensor/load cell arrangement. In such an embodiment, the only coupling between the upper and lower platens 102, 104 may be the flexures 302.

In some embodiments, a pivot may alternatively be implemented using an elastic foam or adhesive that couples the upper and lower platens 102, 104 together.

Turning back to FIGS. 3A-3C, in operation, using flexures as the supports 302, the flexures 302 are adapted to bear the thrust, radial, and moment loads created by rotating the lower platen 104 to drive the upper platen 102, yet allow only one degree of freedom (e.g., rotational) for the upper platen 102 to move relative to the lower platen 104. Note that, as explained above, the one degree of freedom may be limited by the flexures 302. The driving torque of the actuator 108 (FIG. 1) is passed through the torque/strain measurement instrument (in FIG. 3A, the torque sensor 206; in FIG. 3B, the strain gauge 304; in FIG. 3C, the load cell 212) to the upper platen 102. As the load of the polishing head is applied to the polishing pad on the upper platen 102, the torque/strain measurement instrument (in FIG. 3A, the torque sensor 206; in FIG. 3B, the strain gauge 304; in FIG. 3C, the load cell 212) is adapted to measure the additional torque required to overcome the polishing head load and to maintain the rotation of the upper platen 102.

Figure 6:
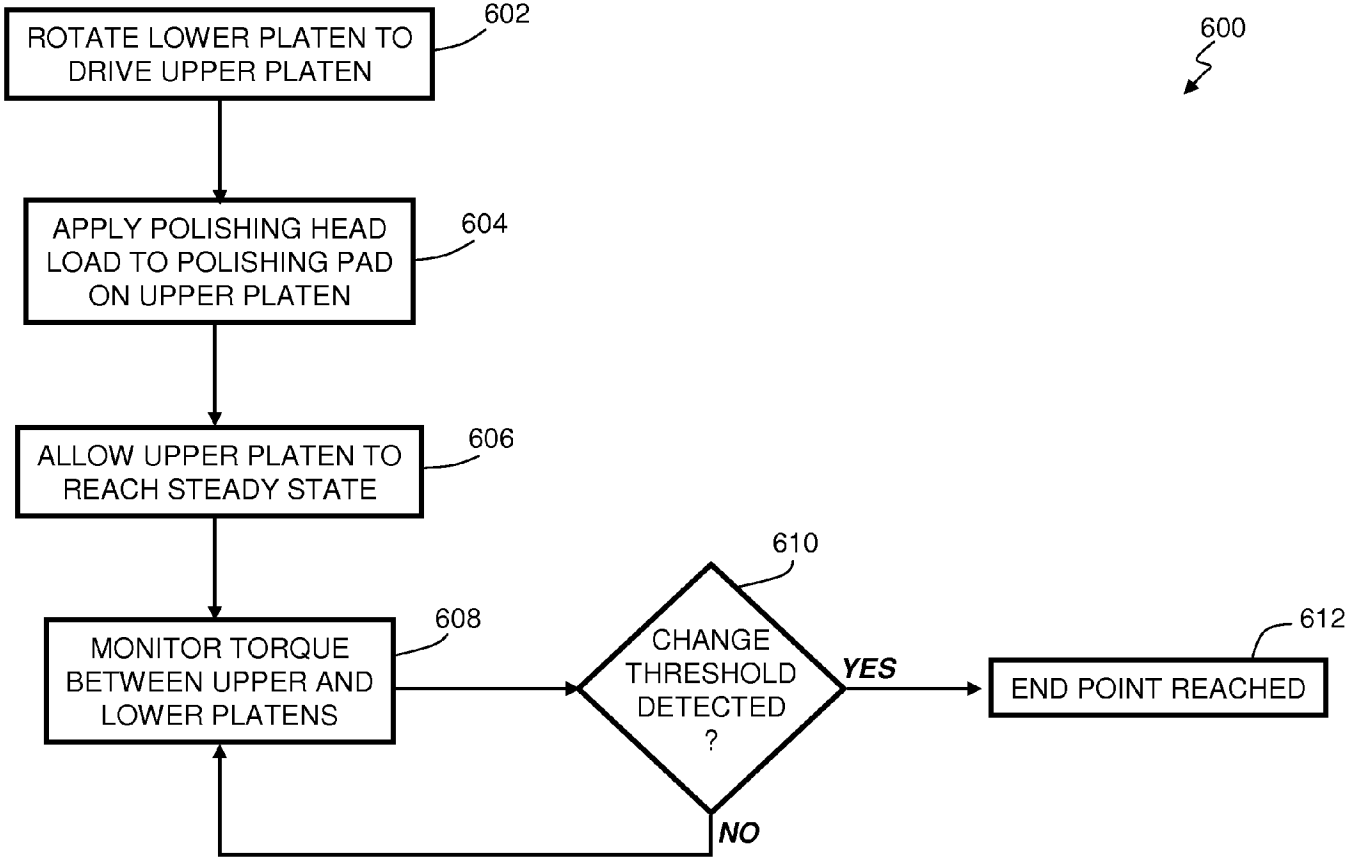
FIG. 6 is a flowchart depicting an exemplary method of polishing a substrate in accordance with some embodiments of the present invention.

Turning to FIG. 6, a flowchart depicting an exemplary method 600 of polishing a substrate according to some embodiments of the present invention is provided. The example method 600 described below may be implemented using any of the above-described embodiments of a CMP system under the control of a computer processor or controller 118. In some embodiments, software instructions executing on a controller or general computer processor may be used to implement the logic described in the following method 600. In other embodiments, the logic of the method 600 may be implemented entirely in hardware.

In Step 602, the actuator 116 rotates the lower platen 104 to drive the upper platen 102 which is holding a polishing pad for polishing a substrate. In Step 604, the polishing head holding the substrate is applied to the polishing pad on the upper platen 102. During material removal with the polishing pad, the downward force of the polishing head holding the substrate creates a resistance to the rotation of the platens 102, 104. In Step 606, the actuator 116 applies additional torque to overcome the resistance and the platens 102, 104 reach a steady state rotation relative to each other. In Step 608, the additional torque is measured using the torque/strain measurement instrument. In some embodiments, for example where flexures 302 are used as supports, the relative rotational or linear displacement may be measured as an indication of the additional torque being applied. In decision Step 610, a torque change threshold is compared to the measured torque. If the amount of torque measured over time changes less than the torque change threshold, the system 100 continues the polishing/material removal and flow returns to Step 608 where the torque is measured again. If the amount of torque change measured over time is at or above the torque change threshold, the system 100 determines that the polishing end point has been reached. In some embodiments, the substrate in the polishing head is lifted from the polishing pad on the upper platen 102. In some embodiments, the detected end point may merely represent a transition from one layer of material to a second layer of material and the polishing may continue until a final end point is reached at Step 612.

Figure 7:
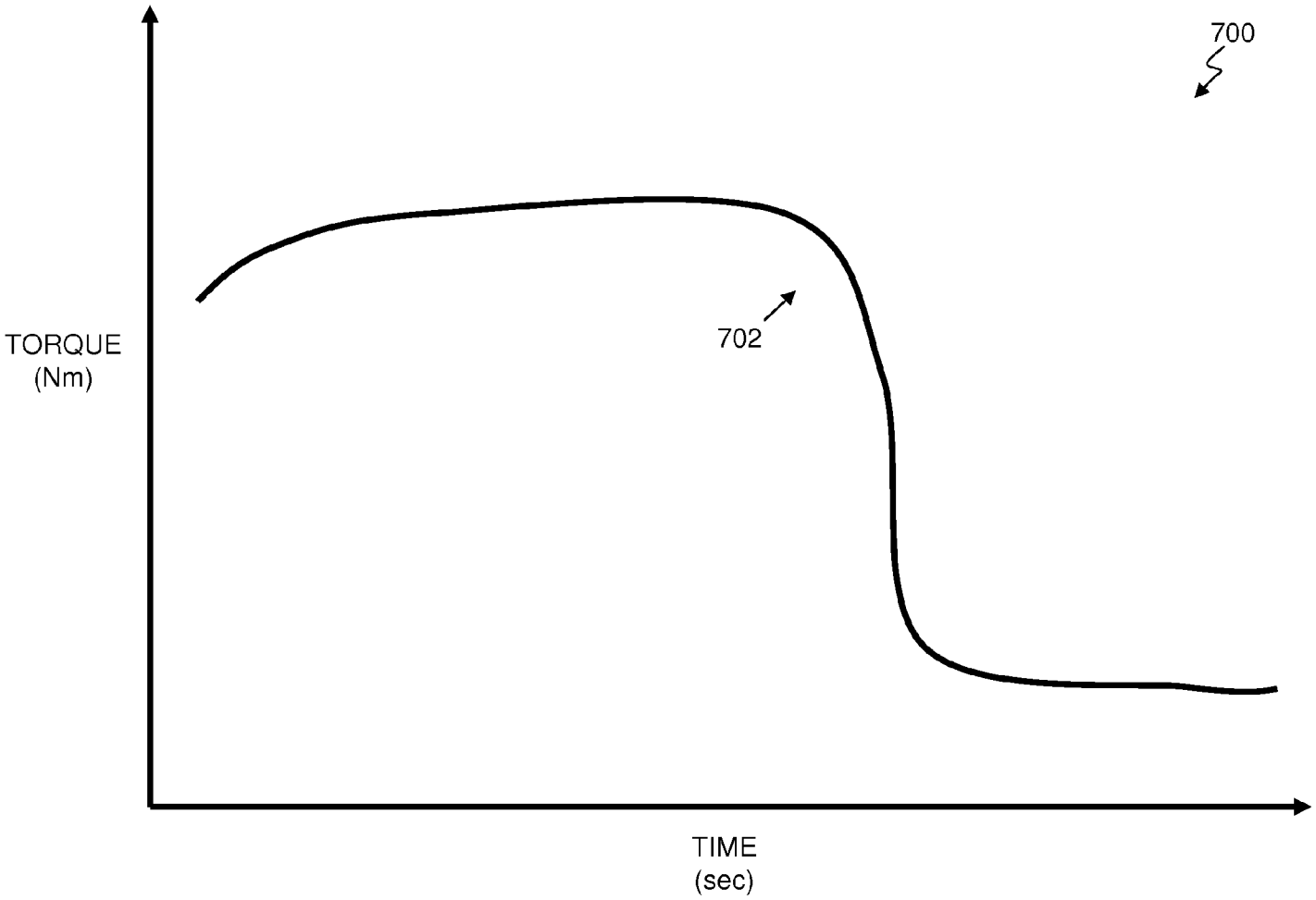
FIG. 7 is a graph of experimental results of measuring torque over time as a substrate is polished using an embodiment of a substrate polishing system in accordance with an embodiment of the present invention.

Turning to FIG. 7, an exemplary graph 700 of torque plotted as a function of time during a polishing process is provided. The graph depicts experimental results achieved using an embodiment of the present invention. Although a particular shape is shown, the shape is merely illustrative and not intended to limit the scope of the invention in any manner.

During an exemplary polishing process, the polishing head load is applied to the polishing pad on the upper platen 102. The lower platen 104 drives the upper platen 102 to overcome the resistance of the load. A first material is steadily removed from the substrate during polishing, and the trend of torque required to drive the platen 104 remains relatively constant. As the first material is cleared and polishing of a second material underlying the first material begins, a relatively abrupt change 702 in the trend of torque required to rotate the upper platen is detected. The magnitude of the change in the trend of torque during clearing of the first material will depend on a number of factors such as relative hardness and/or density of the first and second materials, and/or chemical reaction with slurry, or the like; and the torque required during polishing of the second material may be smaller or larger than the torque required during polishing of the first material. The system 100 may identify the change 702 in torque required to rotate the upper platen 104 as a transition between the first and second materials on the substrate and polishing may be stopped (if the goal is to remove the first material and to leave the second material). In some embodiments, a database of exemplary torque values or changes during clearing between different material layers may be measured for test substrates and stored within the controller 118 for reference during production processing.

Figure 8A:
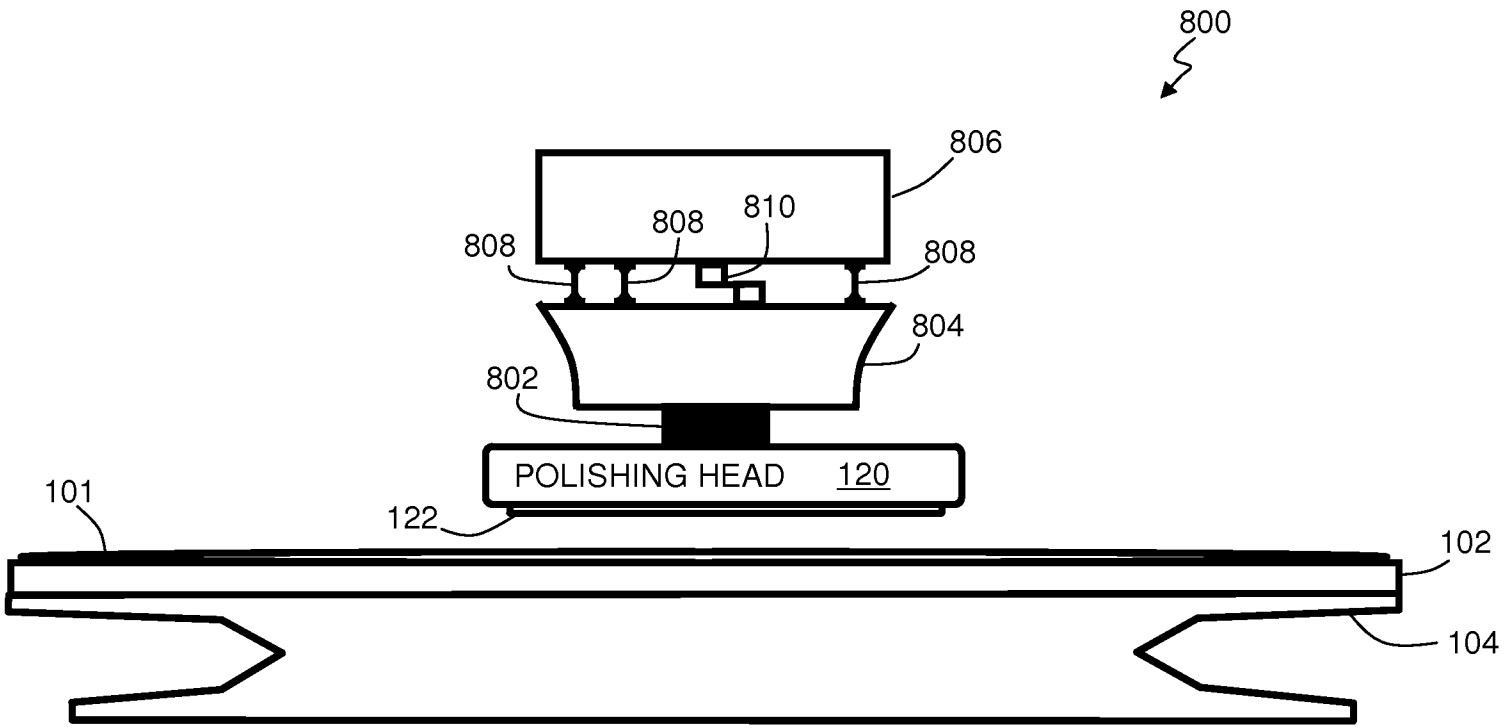
FIG. 8A is a side elevation view of an example polishing head assembly of a substrate polishing system in accordance with side force measurement embodiments of the present invention.
Figure 8B:
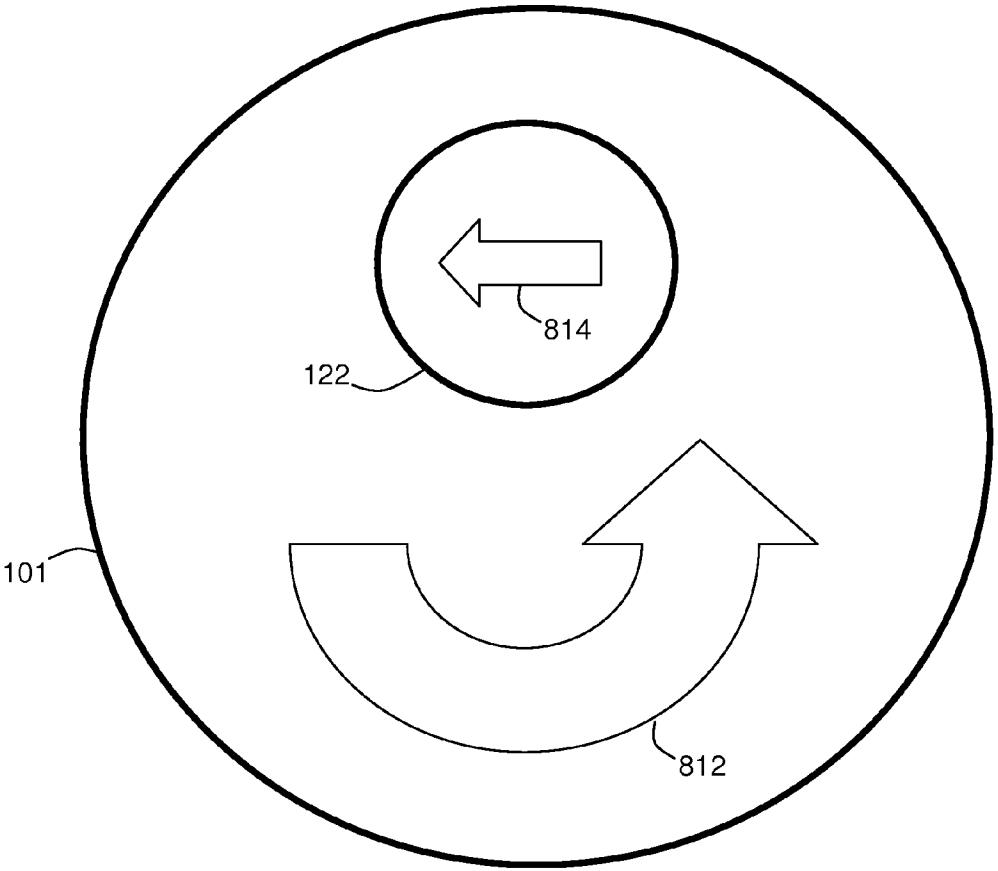
FIG. 8B is a top view of a substrate positioned on a polishing pad during polishing showing the rotation of the pad and the side force on the substrate in accordance with embodiments of the present invention.

Turning now to FIGS. 8A and 8B, an example polishing head assembly of a substrate polishing system 800 in accordance with alternative embodiments of the present invention is shown. FIG. 8B is a top view of a substrate 122 positioned on a polishing pad 101 during polishing showing the rotation 812 of the pad 101 and the side force 814 on the substrate 122. As seen in FIG. 8A, the polishing pad 101 is supported and rotated by the platens 102, 104 under the polishing head 120 which holds the substrate 122. The polishing head 120 is supported by a spindle 802 which is coupled to a lower carriage 804. The lower carriage 804 is coupled to upper carriage 806 by supports 808.

In some embodiments, supports 808 may be implemented using flexures 302 (FIG. 5) or various types of bearings (e.g., linear bearings such as rolling element bearings, fluid bearings, magnetic bearings, etc.). The lower and upper carriages 804, 806 may also be coupled together with a side force measurement instrument 810, for example a load cell or an actuator with a feedback circuit. In some embodiments, a displacement measurement instrument may be used instead of (or in addition to) a side force measurement instrument 810. Displacement measurement instruments may include any type of distance sensor such as a capacitive distance sensor, an inductive distance sensor, an eddy current distance sensor, a laser distance sensor, or the like. Thus, the lower and upper carriages 804, 806 are flexibly coupled to allow relative motion to each other in one direction (e.g., one degree of freedom). For example, the supports 808 may be arranged to allow slight motion in the direction of arrow 814 in FIG. 8B when the substrate 122 is pushed down against the polishing pad 101. Therefore, the force applied to the substrate 122 held in the polishing head 102 by the rotation 812 of the polishing pad 101 when the substrate 122 is pushed against the polishing pad 101 may be measured by the side force measurement instrument 810 (or determined using a displacement measurement instrument).

In some embodiments, an actuator (e.g., a liner actuator) coupled to the upper and lower carriages 806,804 may be adapted to counteract the side force generated by pushing the substrate 122 down against the polishing pad 101. Using a feedback circuit to monitor displacement, load or strain signals from the sensors discussed above, the energy expended by the actuator to maintain the relative positions of the carriages 806,804 may be used to determine the amount of side force being applied at any given moment. As the friction between the pad and the substrate changes, the energy required to maintain the relative positions of the carriages changes. Using a feedback signal from the actuator (e.g., the amount of current drawn to maintain the relative positions of the carriages), the energy expended may be determined. Thus, in some embodiments, instead of a side force measurement instrument 810 or a displacement measurement instrument, an actuator with a feedback circuit and basic sensors may be used to determine the amount of friction between the substrate and the polishing pad.

Note also that in embodiments that measure the torque between the upper and lower platens (e.g., FIGS. 2A through 3C), an actuator (e.g., a rotational actuator) with a feedback circuit, coupled between the platens may be used in place of a torque measurement device. The actuator and feedback circuit may be used to maintain the relative positions of the platens and the energy exerted to do so may be used to determine the amount of friction between the substrate and the polishing pad.

Likewise, in embodiments that measure the torque between the upper and lower platens (e.g., FIGS. 2A through 3C), relative displacement may be measured instead of, or in addition to, torque measurement. As with the displacement between the carriages measurement embodiments, displacement between the platens measurement instruments may include any type of distance sensor such as a capacitive distance sensor, an inductive distance sensor, an eddy current distance sensor, a laser distance sensor, or the like.

In some embodiments, a dampening module may be used to reduce vibration. A dampening module may be used in both side force measurement embodiments (between the carriages) and in torque measurement embodiments (between the platens) of the present invention. In some embodiments, hard stops that limit the range of relative motion between the carriages (and between the platens) may be employed to protect sensing/measurement instruments and to provide structural safety.

Figure 9A:
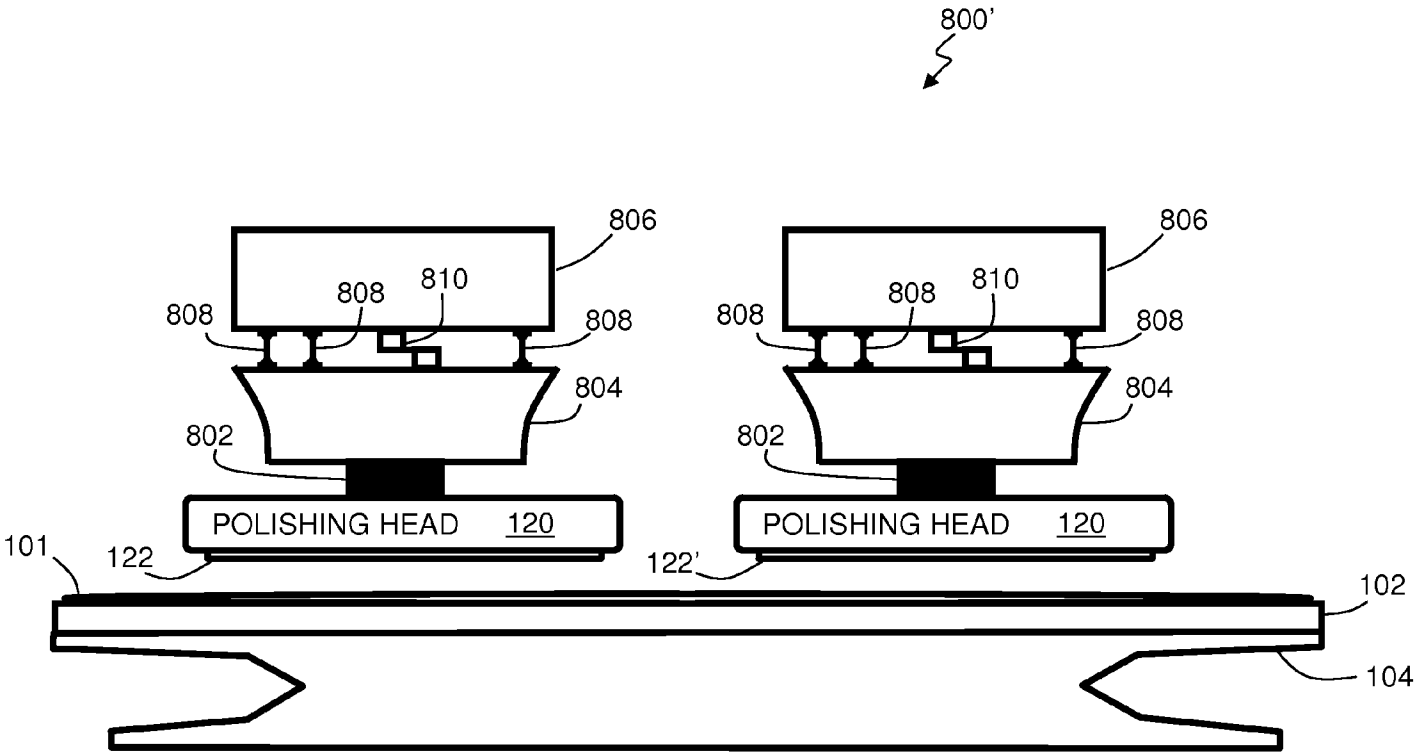
FIG. 9A is a side elevation view of an example polishing head portion of an alternative substrate polishing system in accordance with embodiments of the present invention.
Figure 9B:
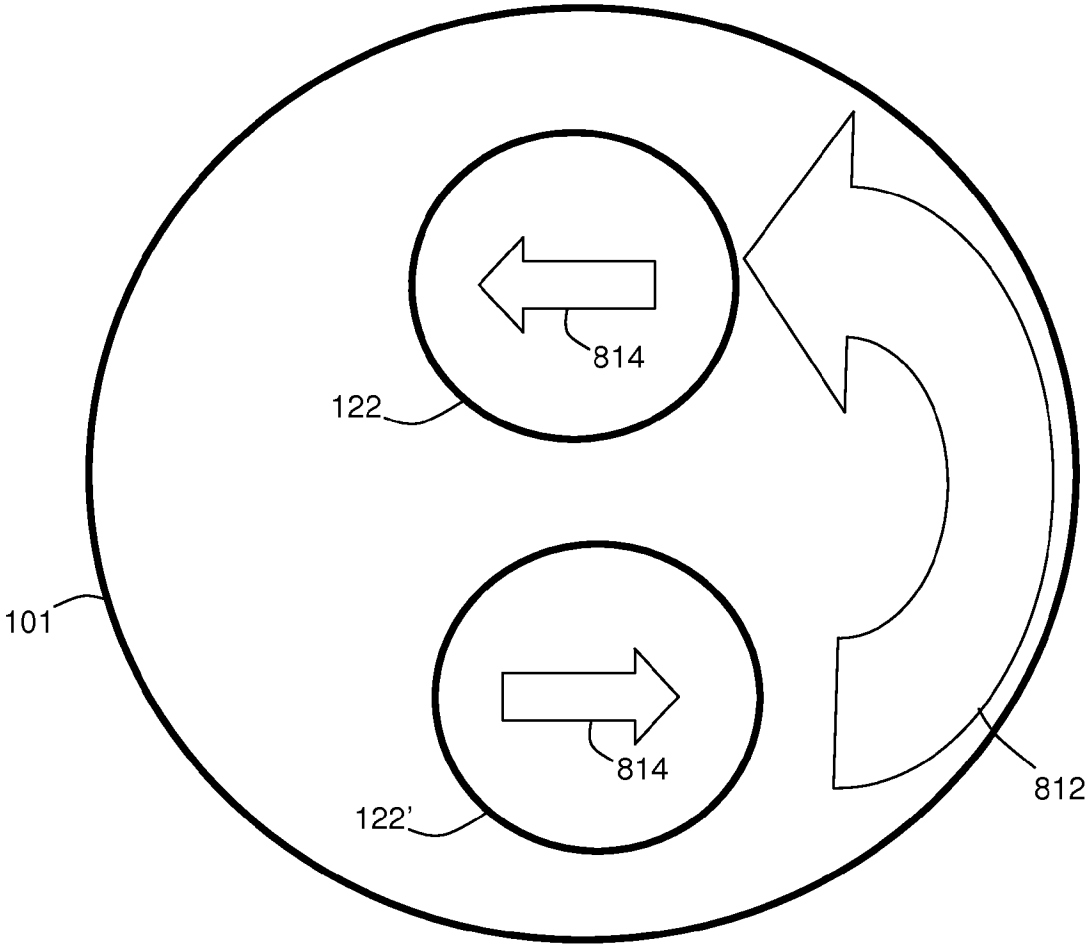
FIG. 9B is a top view of two substrates positioned on a polishing pad during polishing showing the rotation of the pad and the side forces on the substrates in accordance with embodiments of the present invention.

Determining a polishing end point by monitoring changes in the side force 814 on the polishing head 120 may be a desirable alternative to measuring changes in the torque on the platens 102, 104. This may be particularly true with respect to a CMP system 800' that uses two or more polishing heads concurrently on the same polishing pad 101 as depicted in FIGS. 9A and 9B. For example, since two substrates 122, 122' being polished concurrently may be different and thus, may be polished at different rates even on the same CMP system 800', it is desirable to be able to monitor the polishing progress (e.g., in terms of changing friction) of each substrate 122,122' separately.

Figure 10A:
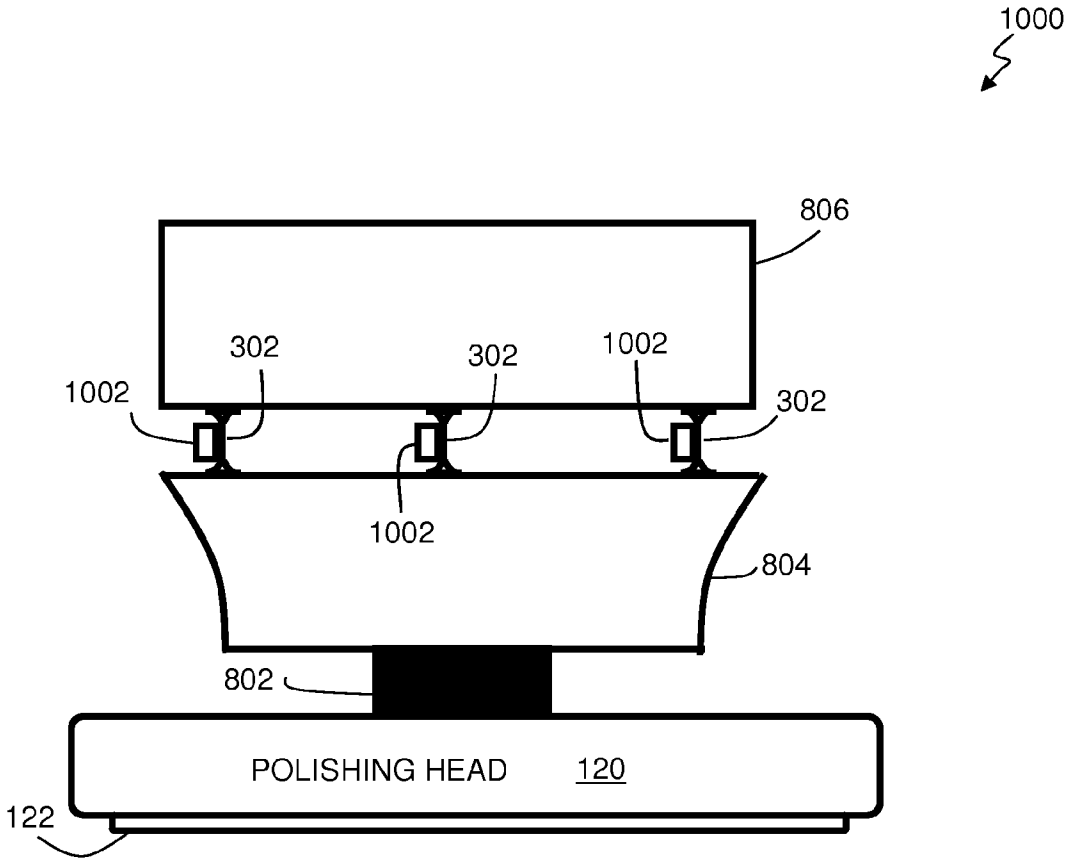
FIG. 10A is a cross-sectional view of a polishing head assembly of a substrate polishing system in accordance with a second side force measurement embodiment of the present invention.
Figure 10B:
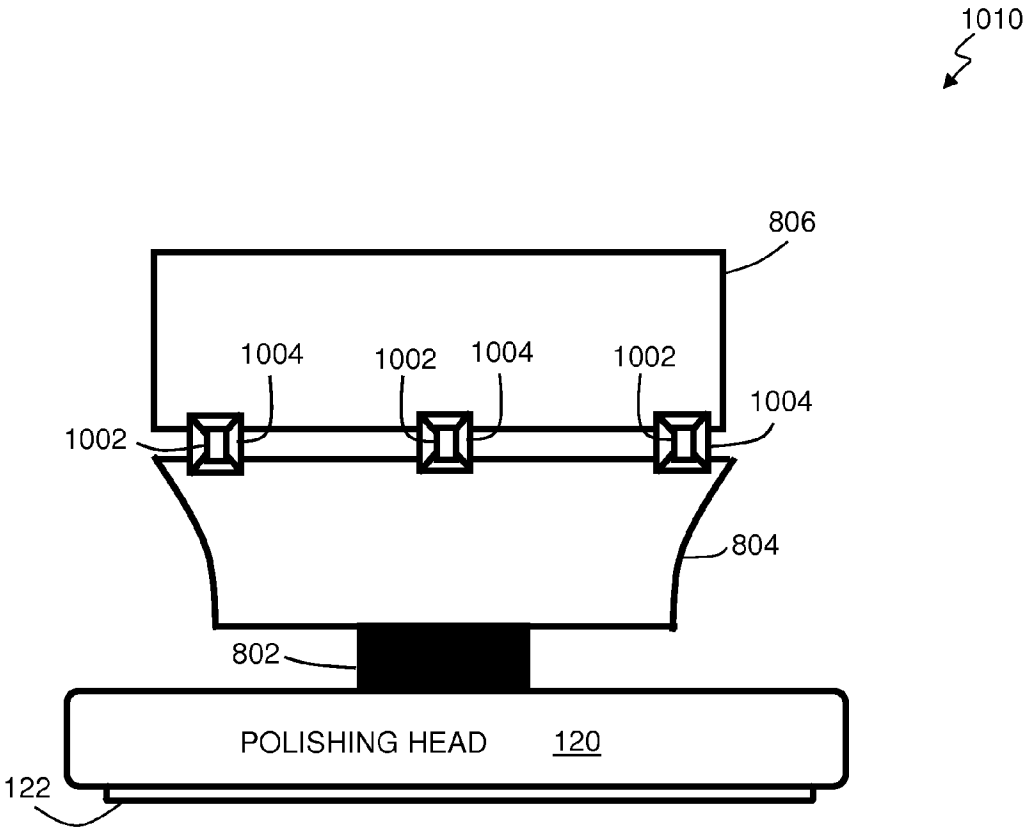
FIG. 10B is a cross-sectional view of a polishing head assembly of a substrate polishing system in accordance with a third side force measurement embodiment of the present invention.
Figure 10C:
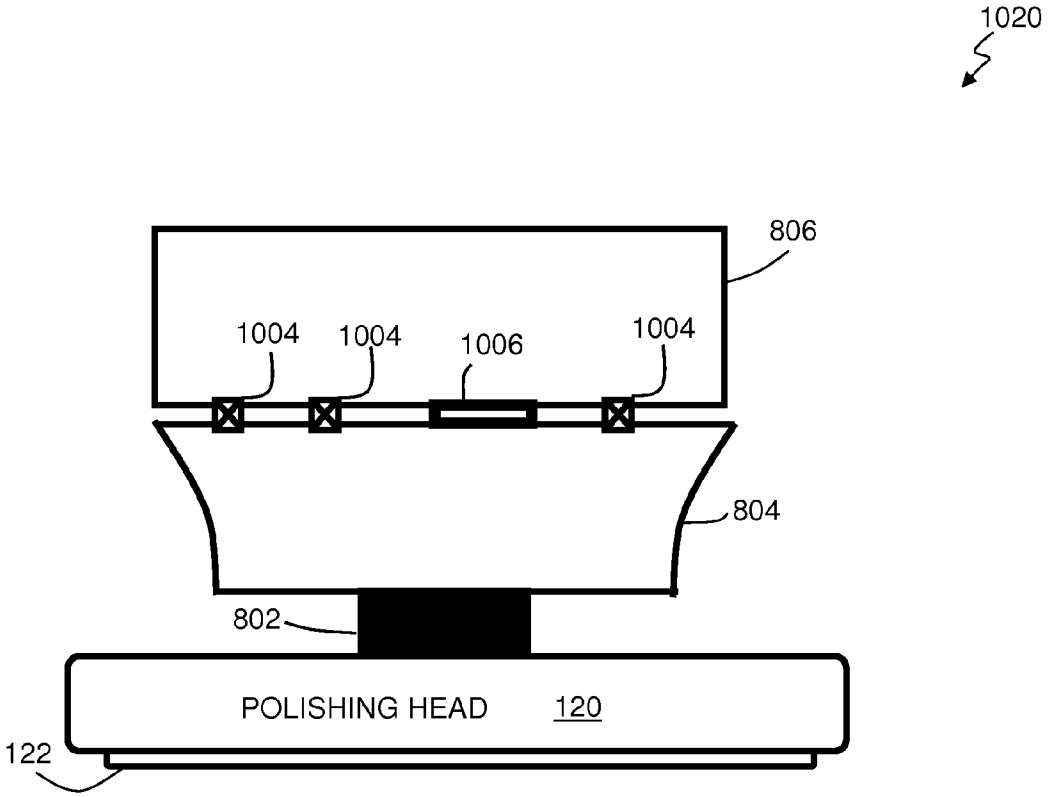
FIG. 10C is a cross-sectional view of a polishing head assembly of a substrate polishing system in accordance with a fourth side force measurement embodiment of the present invention.

Turning now to FIGS. 10A, 10B, and 10C, three additional alternative embodiments of polishing head assemblies 1000, 1010, 1020 using side force measurement are depicted. In each embodiment, a displacement measurement instrument may be used in place of the side force measurement instrument. In FIG. 10A, the supports are implemented using three flexures 302 similar to those depicted in FIG. 5. More or fewer flexures 302 may be used. In this embodiment, the side force measurement instrument is implemented using a strain gauge 1002 mounted on the flexure 302. In FIG. 10A, three strain gauges 1002 are used with one on each flexure 302. Note that fewer strain gauges 1002 may be used.

In FIG. 10B, the supports are implemented using three bearings 1004 (e.g., a linear ball bushing bearing on a rod). More or fewer bearings 1004 may be used. In this embodiment, the side force measurement instrument is implemented using a strain gauge 1002 mounted on the bearing 1004. In FIG. 10B, three strain gauges 1002 are used, one on each bearing 1004. Note that fewer strain gauges 1002 may be used.

In FIG. 10C, the supports are implemented using three bearings 1004 (e.g., a linear ball bushing bearing on a rod). More or fewer bearings 1004 may be used. In this embodiment, the side force measurement instrument is implemented using a load cell 1006 mounted between the upper and lower carriages 806, 804. In the embodiment of FIG. 10C, one load cell 1006 is used. Note that more load cells 1006 may be used. Examples of a load cell 1006 that are commercially available and may be used in some embodiments are the In-Line Load Cell models manufactured by Honeywell Inc. of Columbus, Ohio. Other practicable load cells may be used. For example, a load cell array may be used in some embodiments. In some embodiments, multiple load cells 1006 may be disposed between the carriages 804, 806. Note that in the above embodiments, any combination of the following types of bearings may be used: an air bearing, a fluid bearing, a magnetic bearing, a deep groove bearing, an angular contact bearing, a roller bearing, a linear bearing, and/or a tapered cross-roller bearing. Any other practicable types of bearings may be additionally or alternatively used.

Figure 11:
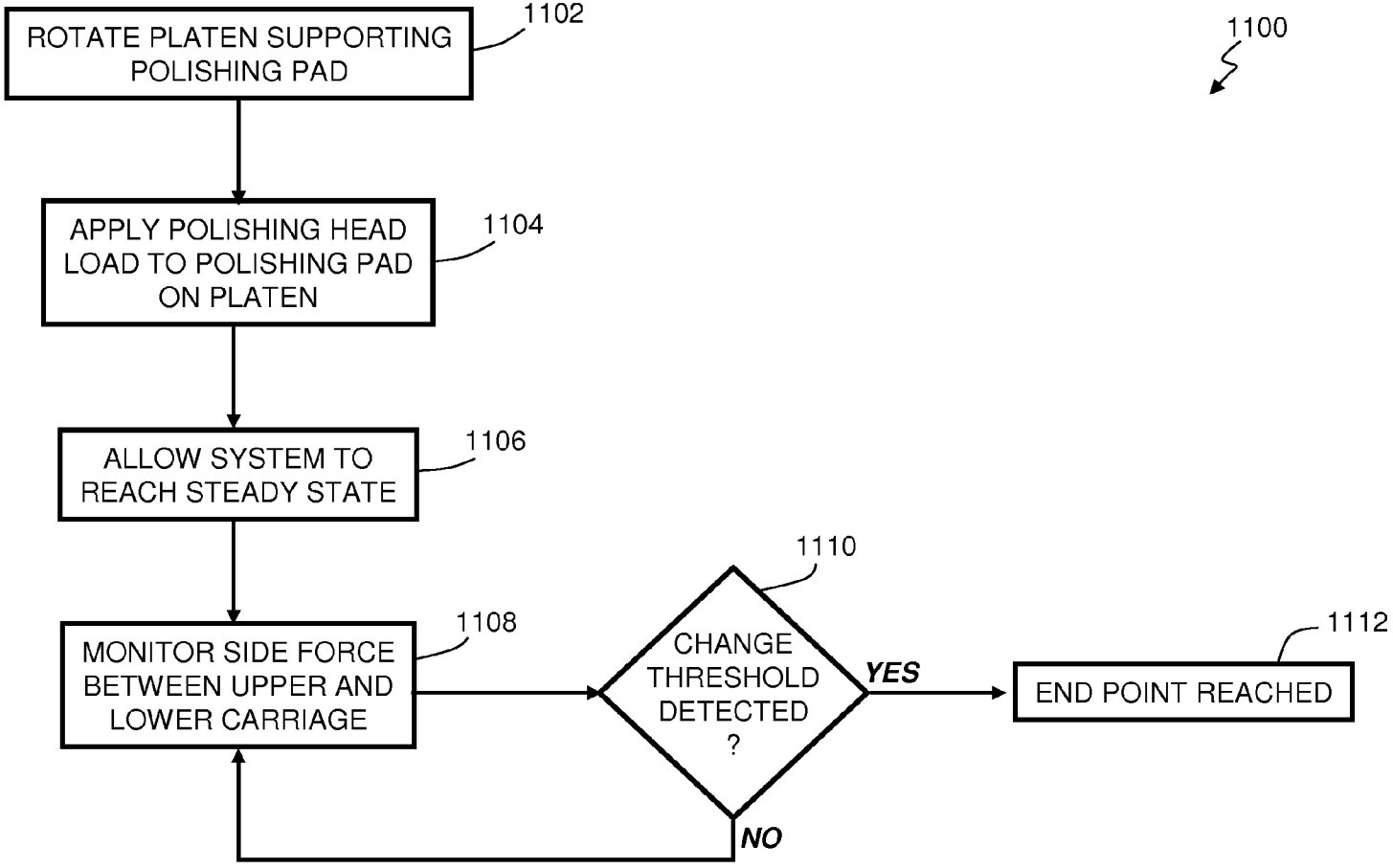
FIG. 11 is a flowchart depicting an alternative exemplary method of polishing a substrate in accordance with some embodiments of the present invention.

Turning to FIG. 11, a flowchart depicting an exemplary method 1100 of polishing a substrate according to some embodiments of the present invention is provided. The example method 1100 described below may be implemented using any of the above-described embodiments of a CMP system under the control of a computer processor or controller 118. In some embodiments, software instructions executing on a controller or general computer processor may be used to implement the logic described in the following method 1100. In other embodiments, the logic of the method 1100 may be implemented entirely in hardware.

In Step 1102, an actuator rotates a platen which is holding a polishing pad for polishing a substrate. In Step 1104, the polishing head holding the substrate is applied to the polishing pad on the platen. During material removal with the polishing pad, the downward force of the polishing head holding the substrate creates a resistance (e.g., friction) to the rotation of the platen. In Step 1106, the actuator applies additional torque to overcome the resistance and the system reaches a steady state rotation. In Step 1108, the friction is measured in terms of side force using a side force measurement instrument disposed between the upper and lower carriages. In some embodiments, for example where flexures are used as supports, the relative displacement may be measured as an indication of the side force being applied. In decision Step 1110, a side force change threshold is compared to the measured side force. If the amount of side force measured over time changes less than the side force change threshold, the system continues the polishing/material removal and flow returns to Step 1108 where the side force is measured again. If the amount of side force change measured over time is at or above the side force change threshold, the system determines that the polishing end point has been reached in Step 1112.

In some embodiments, the substrate in the polishing head is lifted from the polishing pad on the platen once the end point has been reached in Step 1112. In some embodiments, the detected end point may merely represent a transition from one layer of material to a second layer of material, and the polishing may continue until a final end point is reached. In some embodiments with multiple polishing heads, the above-described steps (1104-1112) may be executed concurrently but independently by the different polishing heads. In other words, a first polishing head may reach an end point and load a new substrate while a second polishing head continues to monitor side force waiting for the change threshold to be reached.

Accordingly, while the present invention has been disclosed in connection with the preferred embodiments thereof, it should be understood that other embodiments may fall within the spirit and scope of the invention, as defined by the following claims.

The invention claimed is:

1. An apparatus for polishing a substrate, the apparatus comprising:

an upper platen;

a torque/strain measurement instrument coupled to the upper platen; and a lower platen coupled to the torque/strain measurement instrument and adapted to drive the upper platen to rotate through the torque/strain measurement instrument, wherein the torque/strain measurement instrument includes an arrangement of a plurality of flexures, at least one flexure including a strain gauged coupled thereto, and wherein the plurality of flexures each have an I-beam shape.

2. The apparatus of claim 1 wherein the flexures function as a support adapted to support the upper platen on the lower platen.

3. The apparatus of claim 1 further comprising a coupling adapted to couple the torque/strain measurement instrument to the upper platen.

4. The apparatus of claim 1 wherein the torque/strain measurement instrument includes a torque sensor.

5. The apparatus of claim 1 wherein the torque/strain measurement instrument includes a load cell.

6. A system for chemical-mechanical planarization processing of substrates, the system comprising:

a polishing head adapted to hold a substrate; and a polishing pad support adapted to hold and rotate a polishing pad against the substrate held in the polishing head, the polishing pad support including:

an upper platen;

a torque/strain measurement instrument coupled to the upper platen; and a lower platen coupled to the torque/strain measurement instrument and adapted to drive the upper platen to rotate through the torque/strain measurement instrument, wherein the torque/strain measurement instrument includes an arrangement of a plurality of flexures, at least one flexure including a strain gauged coupled thereto, and wherein the plurality of flexures each have an I-beam shape.

7. The system of claim 6 wherein the flexures function as a support adapted to support the upper platen on the lower platen.

8. The system of claim 6 further comprising a coupling adapted to couple the torque/strain measurement instrument to the upper platen.

9. The system of claim 6 wherein the torque/strain measurement instrument includes a torque sensor.

10. The system of claim 6 wherein the torque/strain measurement instrument includes a load cell.

11. A method of polishing a substrate, the method comprising:

coupling a lower platen to an upper platen via a torque/strain measurement instrument, the upper platen adapted to hold a polishing pad wherein the torque/strain measurement instrument includes an arrangement of a plurality of flexures each have an I-beam shape;

rotating the lower platen to drive the upper platen;

applying a polishing head holding a substrate to the polishing pad on the upper platen; and measuring an amount of torque needed to rotate the upper platen as the substrate is polished.

12. The method of claim 11 further comprising:

detecting a polishing end point based upon detecting a change in the measured amount of torque relative to a threshold.

13. The method of claim 11 wherein the torque is measured using a torque sensor.

14. The method of claim 11 wherein the torque is measured using a load cell.

* * * * *